US011453831B2

(12) United States Patent
Lim et al.

(10) Patent No.: US 11,453,831 B2
(45) **Date of Patent: *Sep. 27, 2022**

(54) PYROLYSIS GASIFIER COMPRISING AUTOMATIC ASH PROCESSOR

(71) Applicants: Yung Taek Lim, Seoul (KR); Deok Jun Rim, Seoul (KR)

(72) Inventors: Yung Taek Lim, Seoul (KR); Deok Jun Rim, Seoul (KR)

( * ) Notice: Subject to any disclaimer, the term of this patent is extended or adjusted under 35 U.S.C. 154(b) by 66 days.

This patent is subject to a terminal disclaimer.

(21) Appl. No.: 17/189,271

(22) Filed: Mar. 2, 2021

(65) Prior Publication Data

US 2021/0179955 A1 Jun. 17, 2021

Related U.S. Application Data

(63) Continuation of application No. 16/439,673, filed on Jun. 12, 2019, now Pat. No. 10,968,407, which is a continuation of application No. PCT/KR2018/000033, filed on Jan. 2, 2018.

(30) Foreign Application Priority Data

Jan. 3, 2017 (KR) ..... 10-2017-0000492

(51) Int. Cl.

| | |
|---|---|
| ***C10J 3/84*** | (2006.01) |
| ***C10J 3/00*** | (2006.01) |
| ***C10J 3/74*** | (2006.01) |

(52) U.S. Cl.

CPC ..... *C10J 3/84* (2013.01); *C10J 3/002* (2013.01); *C10J 3/74* (2013.01); *C10J 2200/09* (2013.01); *C10J 2200/36* (2013.01); *C10J 2300/0946* (2013.01); *C10J 2300/1628* (2013.01)

(58) Field of Classification Search

CPC ..... C10J 3/84; C10J 3/002; C10J 3/005; C10J 2300/0946; C10J 2300/1628

See application file for complete search history.

(56) References Cited

U.S. PATENT DOCUMENTS

| | | | |
|---|---|---|---|
| 2,393,710 | A | 1/1946 | Sanford et al. |
| 3,499,401 | A | 3/1970 | Wessberg |
| 3,693,558 | A | 9/1972 | Theoclitus |
| 4,172,425 | A | 10/1979 | Sheridan |

(Continued)

FOREIGN PATENT DOCUMENTS

| | | | |
|---|---|---|---|
| JP | 07-318034 | A | 12/1995 |
| KR | 10-0663734 | B1 | 1/2007 |

(Continued)

OTHER PUBLICATIONS

International Search Report for PCT/KR2018/000033 dated Apr. 27, 2018 from Korean Intellectual Property Office.

*Primary Examiner* — Matthew J Merkling
(74) *Attorney, Agent, or Firm* — Revolution IP, PLLC

(57) ABSTRACT

A pyrolysis gasifier includes a tubular body configured to receive and pyrolyze a combustible waste, a bottom door disposed below the tubular body to selectively seal the tubular body, a main frame supporting the tubular body, a base frame supporting the bottom door, an automatic ash processor configured to, while traveling in one direction, push and remove ash remaining on the bottom door after pyrolysis of the combustible waste, and a guide frame supporting the automatic ash processor and configured to guide the travel of the automatic ash processor.

13 Claims, 11 Drawing Sheets

(56) References Cited

U.S. PATENT DOCUMENTS

| | | | |
|---|---|---|---|
| 2007/0266634 | A1 | 11/2007 | Tsangaris et al. |
| 2008/0147241 | A1 | 6/2008 | Tsangaris et al. |
| 2008/0209807 | A1 | 9/2008 | Tsangaris et al. |
| 2013/0340339 | A1 | 12/2013 | Lee et al. |

FOREIGN PATENT DOCUMENTS

| | | | |
|---|---|---|---|
| KR | 10-0885622 | B1 | 2/2009 |
| KR | 10-2013-0032887 | A | 4/2013 |
| KR | 10-1651789 | B1 | 8/2016 |

(A–A')

PYROLYSIS GASIFIER COMPRISING AUTOMATIC ASH PROCESSOR

CROSS REFERENCE TO PRIOR APPLICATIONS

This application is a Continuation Application of U.S. patent application Ser. No. 16/439,673 filed on Jun. 12, 2019 under 35 U.S.C. § 120, which is a Continuation Application of International application PCT/KR2018/000033 filed on Jan. 2, 2018, which claims priority to Korean application 10-2017-0000492 filed on Jan. 3, 2017, the entire contents of each of the above-identified applications are hereby incorporated by reference.

BACKGROUND

The present invention relates to a pyrolysis gasifier comprising an automatic ash processor.

Disposal of various kinds of wastes such as municipal waste, industrial waste and the like is problematic. One of the disposal methods of wastes is a method of classifying combustible wastes such as wastes including organic substances that can be used as biomass fuel, polypropylene-based synthetic resins, and the like, pyrolyzing the classified wastes, and driving a turbine or generating a steam by utilizing a combustible gas generated through pyrolysis. Use of the gas generated by pyrolyzing the combustible wastes in the gasifier as described above makes it possible to reduce the emission of a carbon dioxide gas, thereby alleviating the problem of global warming.

A pyrolysis gasifier for pyrolyzing wastes has a principle that local combustion is performed by injecting an air into a bottom door where an air nozzle is embedded to face upward and the surrounding wastes are pyrolyzed by this combustion heat. The temperature in the local combustion zone increases up to 1000 degrees C. or more. As a result, ash is clumped in which the glass present in the local combustion zone is molten, the incombustibles such as earth and the like are mixed with the molten glass, and the mixture is cooled and solidified to form a lump.

As used herein, the term "ash" encompasses white ash remaining after completion of pyrolysis and lumps generated by the crank phenomenon.

In order to process the ash remaining after pyrolysis, a bottom door is connected at one side to a tubular body through a hinge. The bottom door is separated from the tubular body and pivoted about the hinge. In this state, an operator performs cleaning by scraping ash down onto a floor using a tool.

In this ash processing process, it is difficult to scrape off the lumps adhering to the floor door due to the crank phenomenon. The floor door is closed and the operator enters the inside of the tubular body through an inspection door to remove the lumps. Thereafter, the bottom door is pivoted downward again to perform cleaning. It is cumbersome to repeat this process several times.

Due to this cumbersome operation, the time required for processing the ash is prolonged, which hinders the continuous process. The pyrolysis process is unnecessarily delayed, resulting in process inefficiency.

In another conventional pyrolysis gasifier, a bottom door is lowered downward by using a hydraulic cylinder and is moved in the lateral direction by using a bogie. Thereafter, the operator performs cleaning to remove ash. At this time, fire may remain partially on the bottom door even after the pyrolysis is finished. In order to remove the fire, it is necessary to spray water onto the bottom door. In this process, there may be posed a problem that the surroundings are contaminated.

Furthermore, the operator has to enter the tubular body through the bottom door in order to remove the lumps generated by crank phenomenon. Since the temperature inside the tubular body may be high even after pyrolysis, there is a problem that the operator may be exposed to the risk of burns.

SUMMARY

The present invention has been proposed in order to solve the problems of the prior art as described above. It is an object of the present invention to provide an ash processor capable of automatically processing the ash generated after pyrolysis without manual operation, and a pyrolysis gasifier comprising the ash processor.

According to an embodiment of the present invention, there may be provided a pyrolysis gasifier, comprising a tubular body configured to receive and pyrolyze a combustible waste, a bottom door disposed below the tubular body to selectively seal the tubular body, a main frame supporting the tubular body, a base frame supporting the bottom door, an automatic ash processor configured to, while traveling in one direction, push and remove ash remaining on the bottom door after pyrolysis of the combustible waste, and a guide frame supporting the automatic ash processor and configured to guide the travel of the automatic ash processor.

According to the embodiments of the present invention, it is possible to automatically process ash without requiring an operator to manually process the ash. This makes it possible to continuously operate the pyrolysis gasifier. Thus, there is an effect that the time required for manually processing the ash is reduced and the process efficiency is enhanced.

In addition, there is an effect that it is possible to eliminate the risk of burning an operator due to the remaining fire or the like in the ash processing process.

DETAILED DESCRIPTION

Hereinafter, embodiments of the present invention will be described in detail with reference to the drawings. In the following description of the present invention, a detailed description of well-known configurations or functions will be omitted when it determined that such a description may obscure the subject matter of the present invention.

Figure 1:
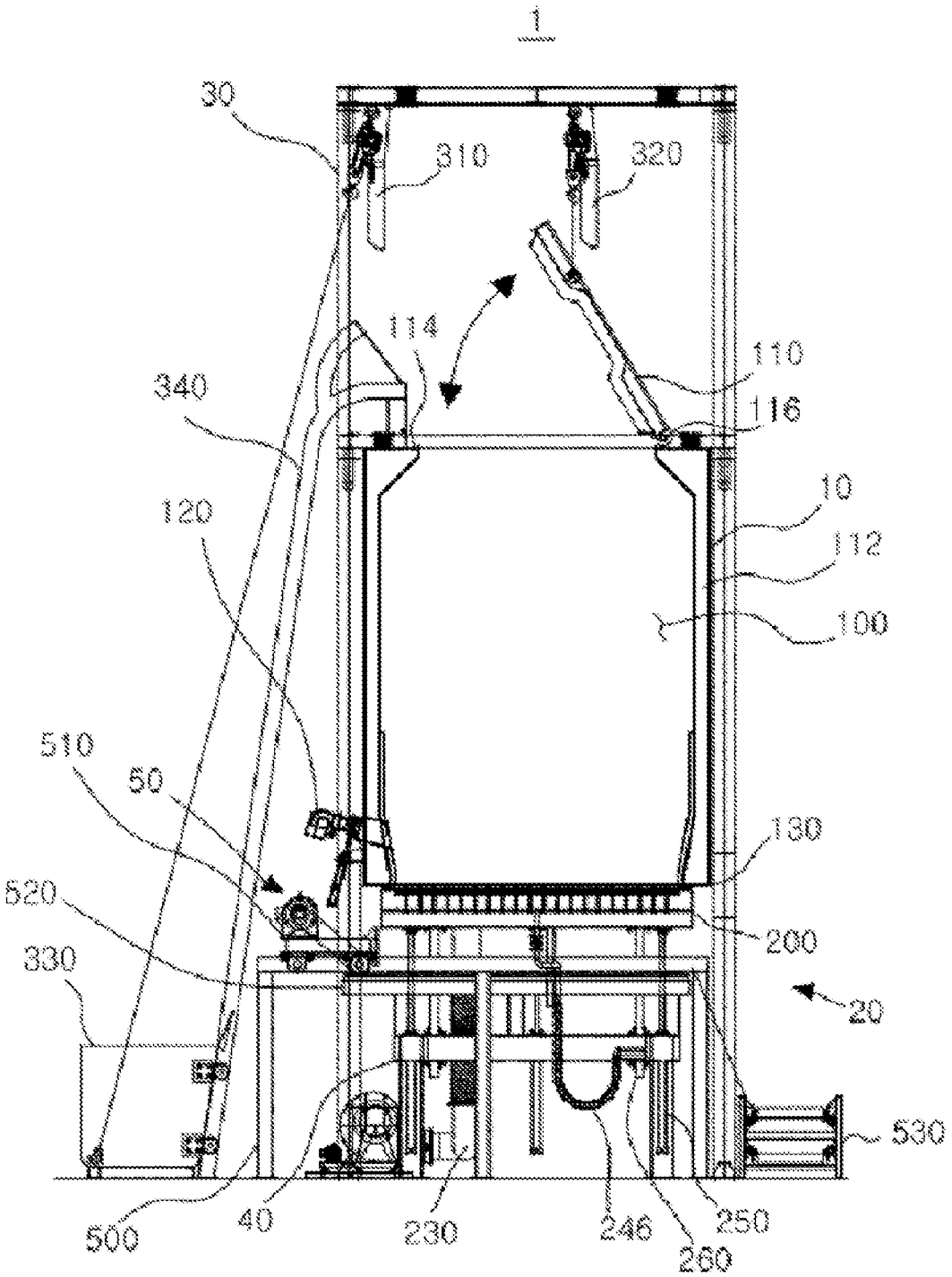
FIG. 1 is a view showing a pyrolysis gasifier according to an embodiment of the present invention.
Figure 2:
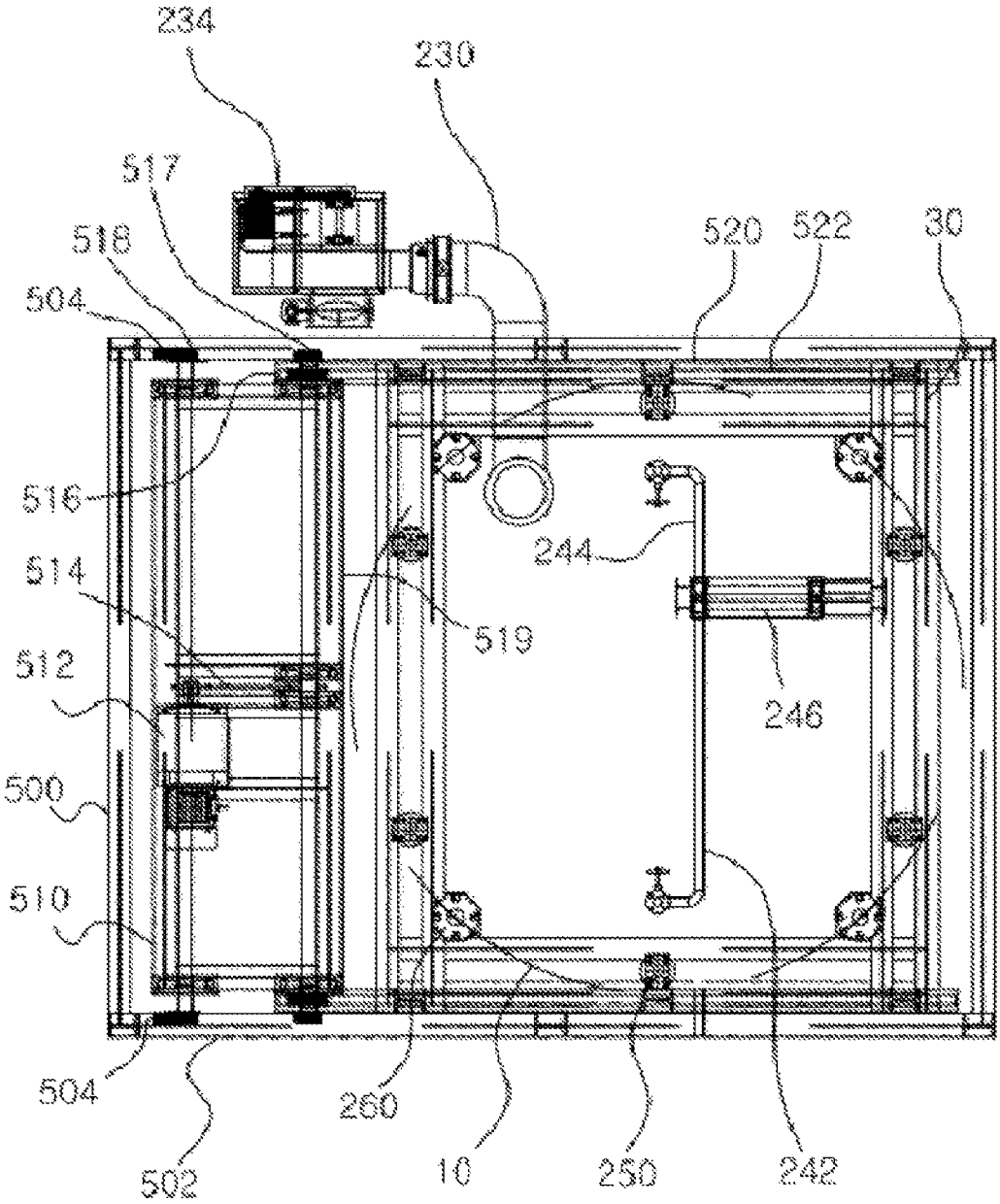
FIG. 2 is a plan view showing a lower portion of the pyrolysis gasifier shown in FIG. 1.
Figure 3:
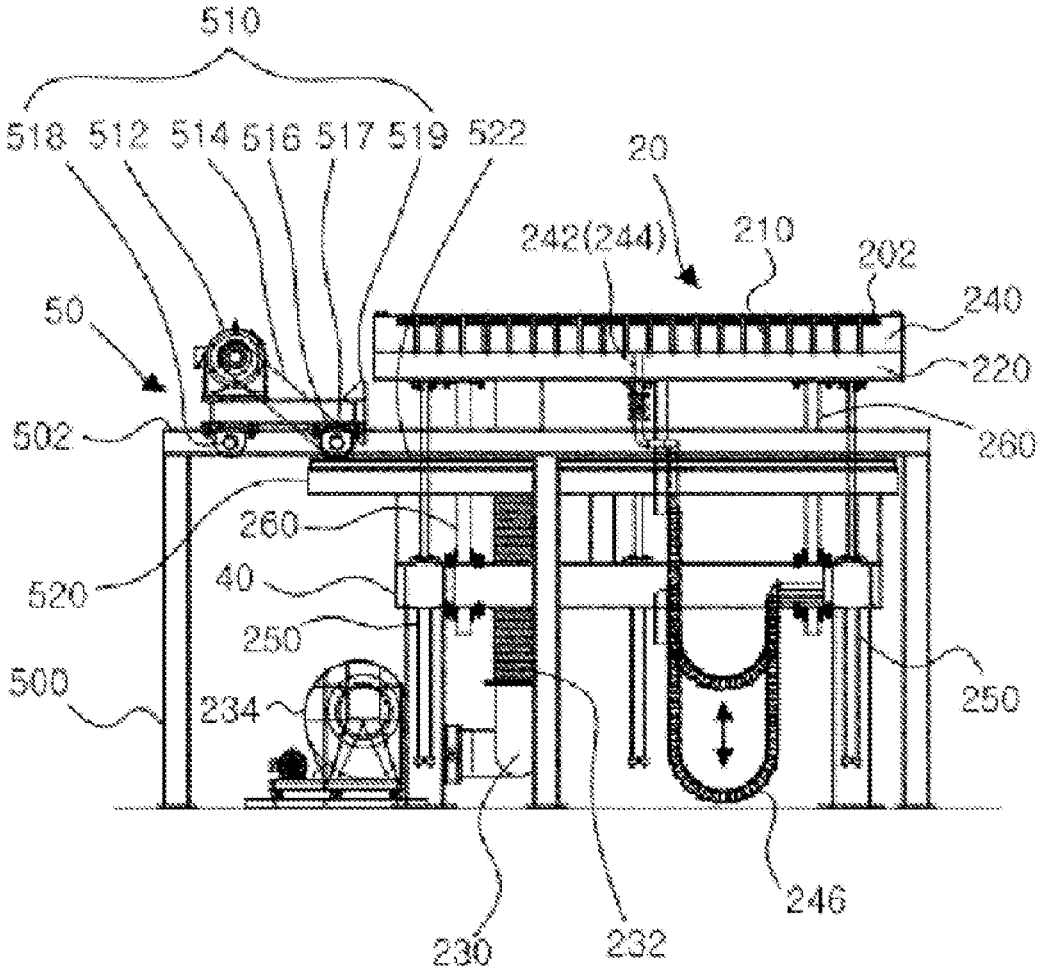
FIG. 3 is an enlarged view showing the lower portion of the pyrolysis gasifier shown in FIG. 1.
Figure 4:
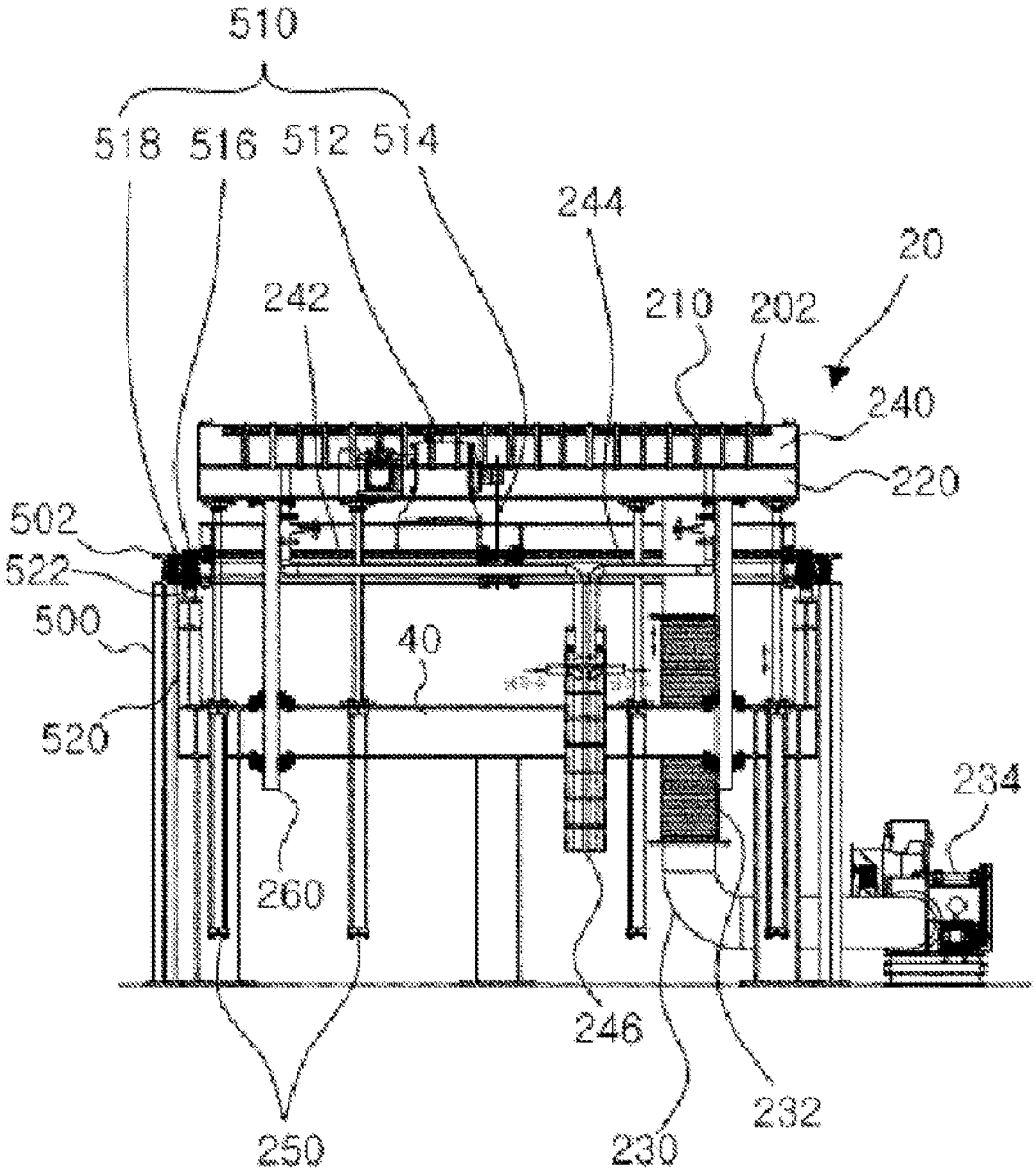
FIG. 4 is a view of the lower portion of the pyrolysis gasifier shown in FIG. 1, which is seen at an angle different from the angle of FIG. 3.

FIG. 1 is a view showing a pyrolysis gasifier according to an embodiment of the present invention. FIG. 2 is a plan view showing a lower portion of the pyrolysis gasifier shown in FIG. 1. FIG. 3 is an enlarged view showing the lower portion of the pyrolysis gasifier shown in FIG. 1. FIG. 4 is a view of the lower portion of the pyrolysis gasifier shown in FIG. 1, which is seen at an angle different from the angle of FIG. 3.

Referring to FIGS. 1 to 4, a pyrolysis gasifier 1 according to an embodiment of the present invention may include a tubular body 10 configured to receive and pyrolyze combustible wastes, a bottom door 20 disposed below the tubular body 10 and configured to selectively seal the tubular body 10, a main frame 30 configured to support the tubular body 10, a base frame 40 configured to support the bottom door 20, and an ash processing module 50 configured to remove ash X on the bottom door 20.

Each of the main frame 30, the base frame 40 and the below-described guide frame 500 may be configured as a hexahedral frame-like structure having a plurality of I-beams connected to each other. A first hoist 310 and a second hoist 320 may be installed above the main frame 30, and a basket running rail 340 extending in the vertical direction may be installed on the side surface of the main hoist 310. A waste feeding basket 330 may be engaged with the basket running rail 340. The waste feeding basket 330 may be connected to the first hoist 310 and may be provided so as to rise along the basket running rail 340.

Accordingly, when a lid 110 is opened by the operation of the second hoist 320 connected to the lid 110 to be described later, the waste feeding basket 330 having wastes contained therein may be raised toward the upper opening of the tubular body 10 by the operation of the first hoist 310 so that the wastes in the waste feeding basket 330 can be put into a waste combustion chamber 100 in the tubular body 10.

Examples of pyrolytic wastes include SRF molded fuel, SRF non-molded solid fuel, bio-SRF solid fuel, waste tires, TDF made from waste tires in a chip form, and other combustible mixed wastes produced for recycling by mechanically breaking, crushing and sorting municipal wastes or industrial wastes.

The tubular body 10 may include a waste combustion chamber 100 having a pyrolysis space in which wastes are pyrolyzed, a lid 110 for opening and closing an upper surface of the waste combustion chamber 100, an ignition unit 120 provided below the tubular body 10 to ignite wastes, and a lower flange 130 attached to a lower surface of the waste combustion chamber 100.

The waste combustion chamber 100 may have a cylindrical shape opened on the upper and lower surfaces thereof. The upper portion of the pyrolysis space is opened or closed by the lid 110, and the lower portion of the pyrolysis space is opened or closed by the bottom door 20 which will be described later. In addition, when the waste combustion chamber 100 is closed by the lid 110 and the bottom door 20, the waste combustion chamber 100 is kept in a sealed state with respect to the outside. Accordingly, a combustion flame, a gas and the like in the waste combustion chamber 100 may not be discharged to the outside while the wastes are pyrolyzed.

In addition, the waste combustion chamber 100 may be formed by stacking a side refractory wall, a side cooling jacket and an outer wall in the named order from the inside to the outside. The side cooling jacket is configured to receive a coolant from the outside and to allow the coolant to flow therethrough. The coolant flowing through the side cooling jacket may exchange heat with the pyrolysis space, whereby the temperature of the coolant can be increased. The heat energy accumulated in the coolant may be discharged to the outside and may be recycled.

The side refractory wall is disposed between the side cooling jacket and the pyrolysis space. The side refractory wall is made of a material having heat insulating performance to partially inhibit heat exchange between the side cooling jacket and the pyrolysis space, thereby preventing the temperature of the coolant from being excessively increased, or preventing the temperature inside the pyrolysis space from being excessively lowered. The thickness t of the side refractory wall may be determined to fall within a range of 50 to 100 mm. By determining the thickness t of the side refractory wall to fall within this thickness range, there is no risk that the side refractory wall loses its function as a refractory material. It is also possible to solve the problem that the pyrolysis temperature is excessively increased.

The lid 110 has a refractory wall 112 formed to face the inside of the waste combustion chamber 100, thereby preventing the heat inside the waste combustion chamber 100 from being dissipated upward when the lid 110 is closed. Furthermore, the lid 110 may be easily opened or closed as one end of the lid 110 is configured to be pivotable with respect to the waste combustion chamber 100. To this end, a hinge 116 is provided at one end of the lid 110 to connect the lid 110 to the waste combustion chamber 100 so as to be rotatable with the waste combustion chamber 100. On a lower surface of the lid 110 that makes contact with the upper portion of the waste combustion chamber 100 when the lid 110 is closed, a sealing member 114 may be provided at a portion that makes contact with the waste combustion chamber 100. Such a sealing member 114 can prevent the gas present inside the waste combustion chamber 100 from being discharged to the outside.

The ignition unit 120 may be formed at the lower portion of the tubular body 10 and may perform a function of igniting flammable wastes in the waste combustion chamber 100 to generate a flame and to start pyrolysis. To this end, the ignition unit 120 may include an ignition tube for providing a passage through which a spark is introduced into the waste combustion chamber 100, an ignition plug for generating a spark toward the inside of the ignition tube, a damper provided at an end of the ignition tube, and a cylinder configured to slide the damper to open or close the end of the ignition tube. The cylinder may be a pneumatic cylinder, a hydraulic cylinder, or a screw jack.

Accordingly, when a spark is generated from the ignition plug, the spark is delivered to the inside of the waste combustion chamber 100 through the ignition tube to ignite the wastes. If the flammable wastes start to burn after the ignition is performed for a predetermined time, the damper is slid to close the end of the ignition tube. Thus, the spark may be delivered only for the time required for ignition. Even if the operator does not manually ignite the flammable wastes, it is possible to automatically and safely ignite the wastes.

In addition, ignition units 120 may be installed at a plurality of positions along the periphery of the waste combustion chamber 100 and, for example, may be disposed at four positions at regular intervals. In the case of providing a plurality of ignition units 120, they can be collectively controlled by a control unit (not shown).

The lower flange 130 may have a rectangular shape and may have a communication hole formed therein so as to communicate with the pyrolysis space. The lower flange 130 is a member attached to the lower surface of the waste combustion chamber 100. The lower flange 130 may include a packing member configured to seal a gap between the waste combustion chamber 100 and the bottom door 20 when the lower flange 130 is pressed by a seal ring of the bottom door 20. The packing member may be made of an elastic material for constituting a sealing environment. The packing member may be provided to face the bottom door 20 and may be provided in the shape of a rectangular ring depending on the shape of the lower flange 130.

On the other hand, the bottom door 20 is provided below the tubular body 10 to selectively seal the tubular body 10. Thus, the bottom door 20 may close the lower portion of the tubular body 10 when the bottom door 20 is moved toward and brought into close contact with the tubular body 10 on the lower side of the tubular body 10.

The bottom door 20 may include a door body 200, a lower refractory wall 202 provided on a upper surface thereof, an air supply nozzle 210 for supplying an air required for combustion to the pyrolysis space, an air pocket 220 provided with a space capable of collecting an air therein and connected to the air supply nozzle 210 to allow the air collected therein to be discharged through the air supply nozzle 210, an air supply duct 230 connected to the air pocket 220 to provide a passage for supplying an air to the air pocket 220, a lower cooling jacket 240 provided within the door body 200 and provided with an internal space through which a coolant can circulate, a lifting means 250 fixed to the base frame 40 and connected at its end to the door body 200 to move the door body 200 up and down, and a guide post 260 vertically movably installed in the base frame 40 and connected at its upper end to the door body 200.

The air supply nozzle 210 is formed to protrude into a nozzle accommodation groove of the lower refractory wall 202. There may be provided a plurality of air supply nozzles 210. In addition, the air supply duct 230 may be at least partially formed of a bellows tube 232 so that the air supply duct 230 can be extended or retracted when the bottom door 20 moves up or down. The bottom door 20 may further include a blower fan 234 connected to an end of the air supply duct 230 to supply an ambient air to the air pocket 220.

Furthermore, the door body 200 may be stacked in the order of the lower refractory wall 202, the lower cooling jacket 240 and the air pocket 220 from the top.

The lower refractory wall 202 may be made of the same material as the side refractory wall. A plurality of nozzle accommodation grooves may be formed on the upper surface of the lower refractory wall 202 to accommodate the end of the air supply nozzle 210. The air supply nozzle 210 does not protrude above the upper surface of the lower refractory wall 202 because the end of the air supply nozzle 210 is accommodated in the nozzle accommodation grooves. It is therefore possible to prevent the air supply nozzle 210 from being broken due to the collision with the introduced wastes. In addition, the lower refractory wall 202 may be fixed in position in the bottom door 20 by a circular frame provided in the rim portion.

Just like the side cooling jacket, the lower cooling jacket 240 is configured to receive a coolant from the outside and to allow the coolant to flow therethrough. The temperature of the coolant flowing through the lower cooling jacket 240 may be increased due to the heat exchange of the coolant with the pyrolysis space. The heat energy accumulated in the coolant may be discharged to the outside and recycled. Furthermore, the heat exchange between the lower cooling jacket 240 and the pyrolysis space is partially interrupted by the lower refractory wall 202, so that the temperature of the coolant inside the lower cooling jacket 240 is prevented from becoming excessively high or so that the temperature inside the pyrolysis space is prevented from becoming excessively low. The thickness of the lower refractory wall 202 may be determined within the range of 50 to 100 mm as in the case of the side refractory wall.

To this end, the lower cooling jacket 240 may be connected to a coolant supply pipe 242 that provides a passage through which a coolant is supplied from an external coolant supply source (not shown) and a coolant discharge pipe 244 that provides a passage through which a coolant is discharged to the outside. Furthermore, the coolant supply pipe 242 and the coolant discharge pipe 244 are connected at the middle thereof to a high-pressure hose or a flexible hose. The high-pressure hose or the flexible hose may be provided so as to be supported by a cableveyor 246 which can be deformed in shape in response to the upward/downward movement of the door body 200. Accordingly, the coolant supply pipe 242 and the coolant discharge pipe 244 can be prevented from being damaged by the upward/downward movement of the door body 200.

The lifting means 250 may be provided as a member capable of being extended and contracted, and may be constituted by, for example, a hydraulic cylinder, a pneumatic cylinder, a screw jack or the like. A plurality of lifting means 250 is fixed to the base frame 40. The end portion of the lifting means 250 extended and contracted from the base frame 40 is joined to a lower surface of the door body 200. Upon receiving a driving force from the outside, the lifting means 250 is extended or contracted to raise or lower the door body 200. There may be further provided a control unit (not shown) for controlling the driving of the lifting means 250. The control unit may drive the lifting means 250 so that the height of the door body 200 can be adjusted depending on the amount of ash X accumulated on the door body 200.

The guide post 260 may be installed in the base frame 40 and inserted into a through hole so as to be vertically movable. Furthermore, there may be provided components that assist the guide post 260 to be firmly fixed to the base frame 40 so that the guide post 260 can smoothly move up and down. A detailed description thereof will now be made with reference to FIGS. 5 to 7.

Figure 5:
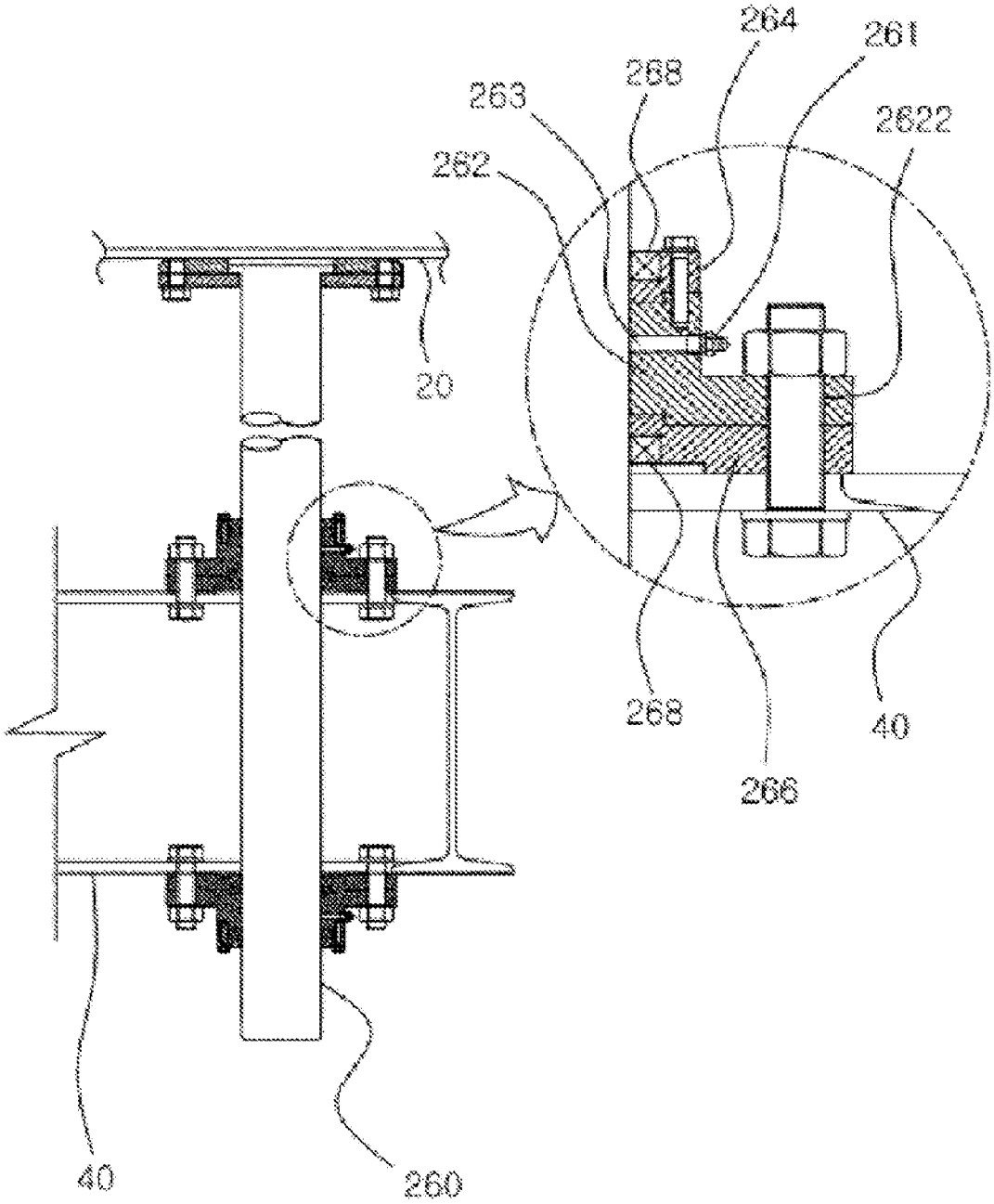
FIG. 5 is an enlarged view of a guide post of the pyrolysis gasifier shown in FIG. 1.
Figure 6:
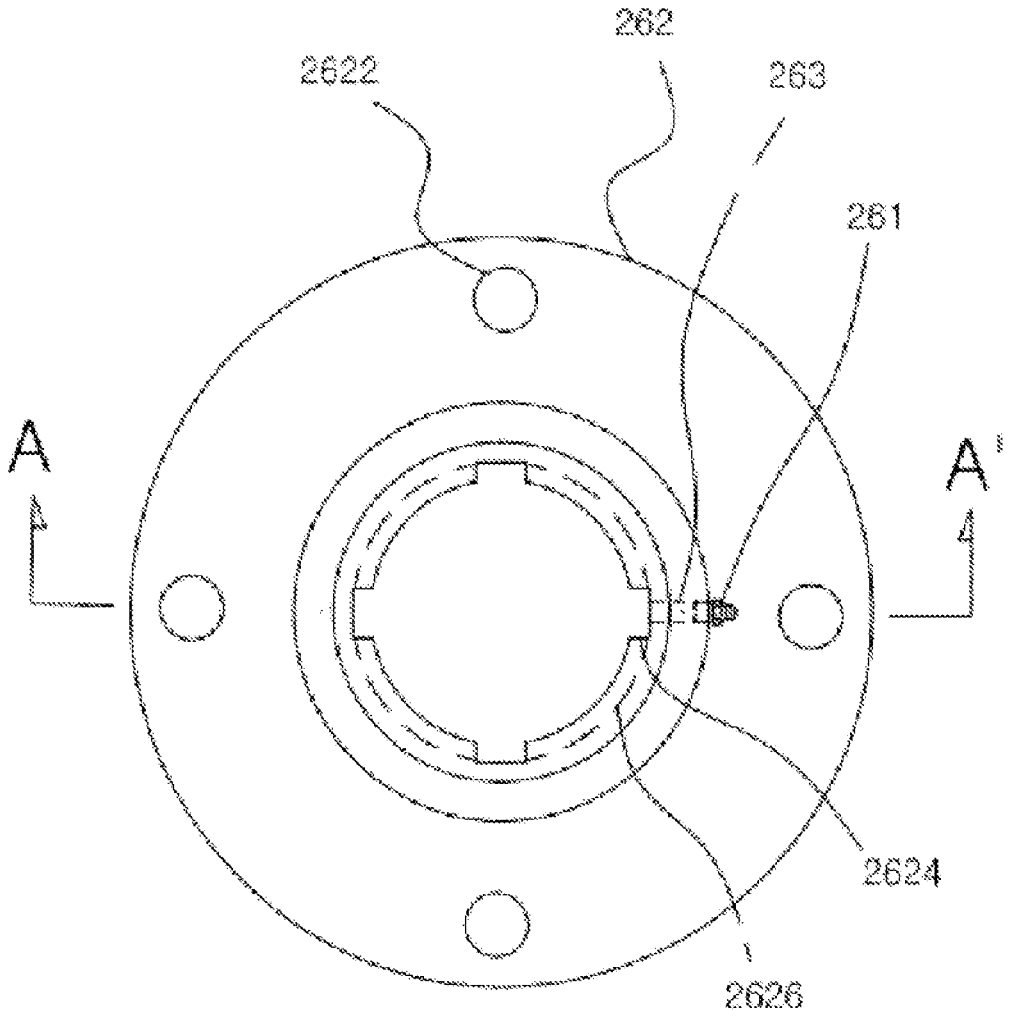
FIG. 6 is a plan view of a main housing shown in FIG. 5.
Figure 7:
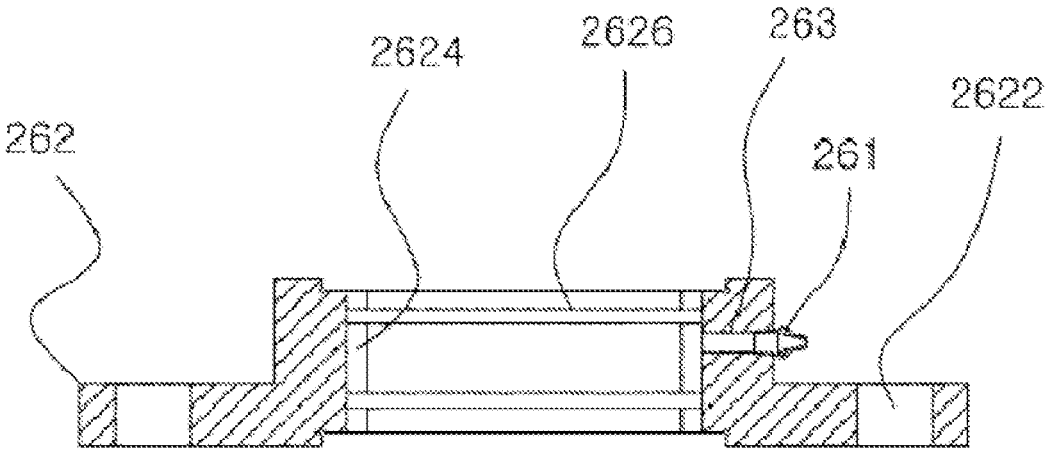
FIG. 7 is a sectional view taken along line A-A in FIG. 6.

FIG. 5 is an enlarged view of the guide post shown in FIG. 1. FIG. 6 is a plan view of a main housing shown in FIG. 5. FIG. 7 is a sectional view taken along line A-A in FIG. 6.

Referring to FIGS. 5 to 7, there may be provided a main housing 262 fixed to the base frame 40 and configured to allow the guide post 260 to vertically movably pass therethrough, an oil supply member 261 installed in the main housing 262, a retainer housing 264 fixed to the upper side of the main housing 262 and configured to allow the guide post 260 to vertically movably pass therethrough, a post housing 266 fixed to the lower side of the main housing 262 and configured to allow the guide post 260 to vertically movably pass therethrough, and an ring-shaped oil retainer 268 installed to prevent a lubricant supplied to the surface of the guide post 260 from leaking out of the retainer housing 264 and the post housing 266.

All the main housing 262, the retainer housing 264 and the post housing 266 has a circular shape as a whole. Holes through which the guide post 260 is inserted may be formed at the centers of the main housing 262, the retainer housing 264 and the post housing 266.

The main housing 262 may have a plurality of fastening holes 2622 spaced apart at predetermined intervals along the circumference of the main housing 262 and may be shaped such that a stepped portion is formed from a portion where the fastening holes 2622 are formed to a central portion. An oil supply hole 263 for supplying a lubricant may be formed on the side surface of the stepped portion so as to extend to the central hole. The oil supply member 261 may be provided at the outer end of the oil supply hole 263.

The oil supply member 261 is a member for periodically supplying a lubricant through the oil supply hole 263, and may be constituted by, for example, a grease oil nipple. Accordingly, the lubricant is periodically supplied to the surface of the central hole of the main housing 262 into which the guide post 260 is inserted, so that the guide post 260 can be smoothly moved up and down.

Vertical grooves 2624 and horizontal grooves 2626 are formed on the surface of the central hole of the main housing 26 through which the guide post 260 passes. The vertical grooves 2624 may be recessed from the surface of the central hole to extend in the vertical direction. One or more vertical grooves 2624 may be formed along the circumference of the central hole through which the guide post 260 passes. Furthermore, the horizontal grooves 2626 may be recessed from the surface of the central hole along the circumference of the central hole through which the guide post 260 passes. One or more horizontal grooves 2626 may be formed depending on the height.

Due to the formation of the vertical grooves 2624 and the horizontal grooves 2626, the lubricant supplied from the oil supply member 261 spreads evenly in the vertical direction and the horizontal direction, so that the lubricating action on the guide post 260 can be made more effective.

The retainer housing 264 is fixed to the upper side of the main housing 262 and may be fastened to the main housing 262 by, for example, bolts. In addition, a ring-shaped oil retainer 268 may be provided at the central portion of the upper surface of the retainer housing 264 that makes contact with the guide post 260.

The post housing 266 is fixed to the lower side of the main housing 262 and has, for example, a hole corresponding to the fastening hole 2622 formed in the main housing 262. The post housing 266 may be fixed to the main housing 262 and the base frame 40 by bolts. Furthermore, the ring-shaped oil retainer 268 may be provided at the central portion of the bottom surface of the post housing 266 that makes contact with the guide post 260.

The oil retainers 268 are respectively provided on the upper surface of the retainer housing 264 and the lower surface of the post housing 266 so as to prevent the lubricant supplied to the surface of the guide post 260 from flowing outward. It is therefore possible to prevent the lubricant from leaking to the outside.

Hereinafter, the specific configuration of the ash processing module 50 will be described with reference to FIGS. 8 to 10. FIG. FIGS. 8 to 10 are views schematically showing an automatic ash processor shown in FIG. 1.

Figure 8:
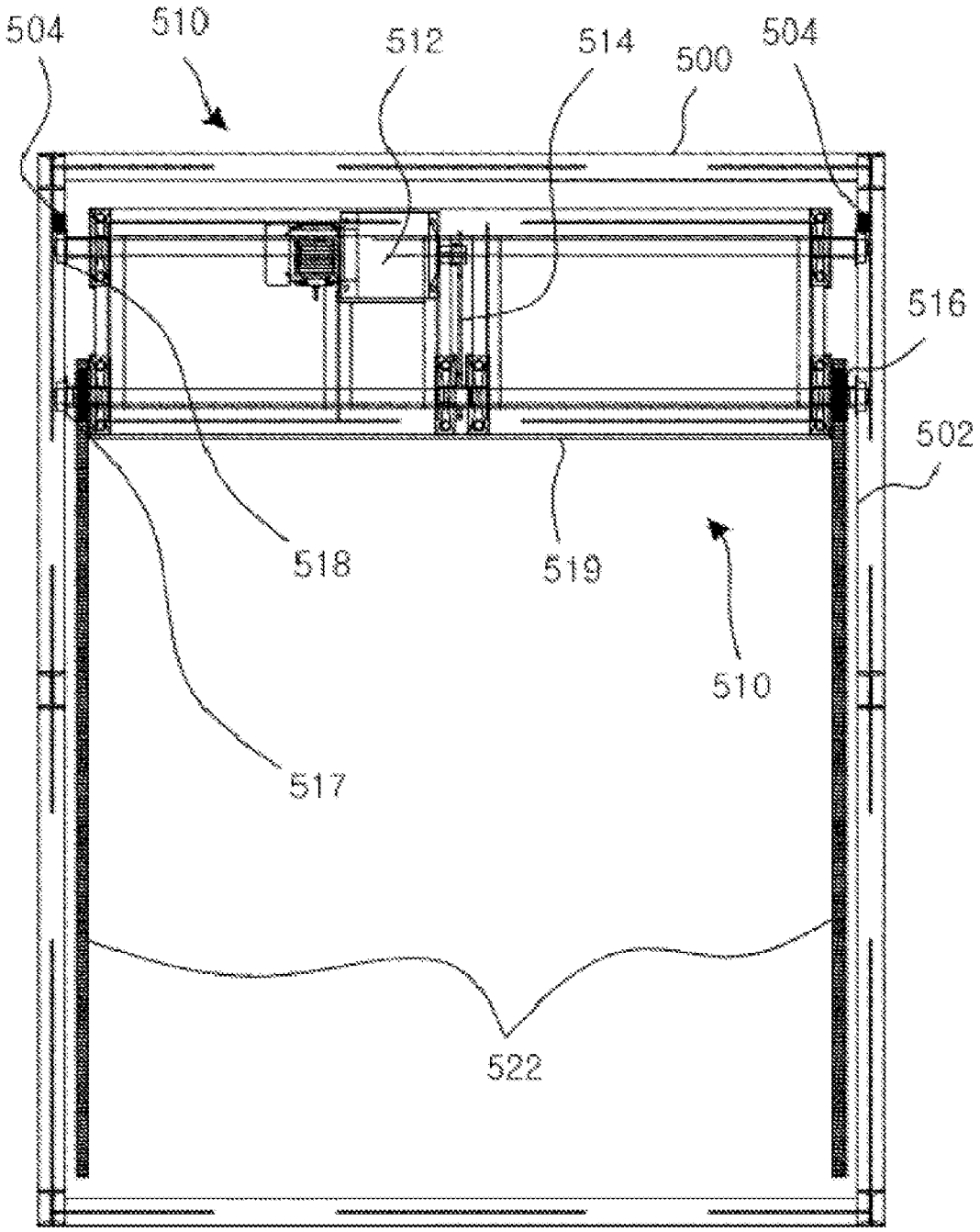
FIGS. 8 to 10 are views specifically showing the automatic ash processor shown in FIG. 1.
Figure 9:
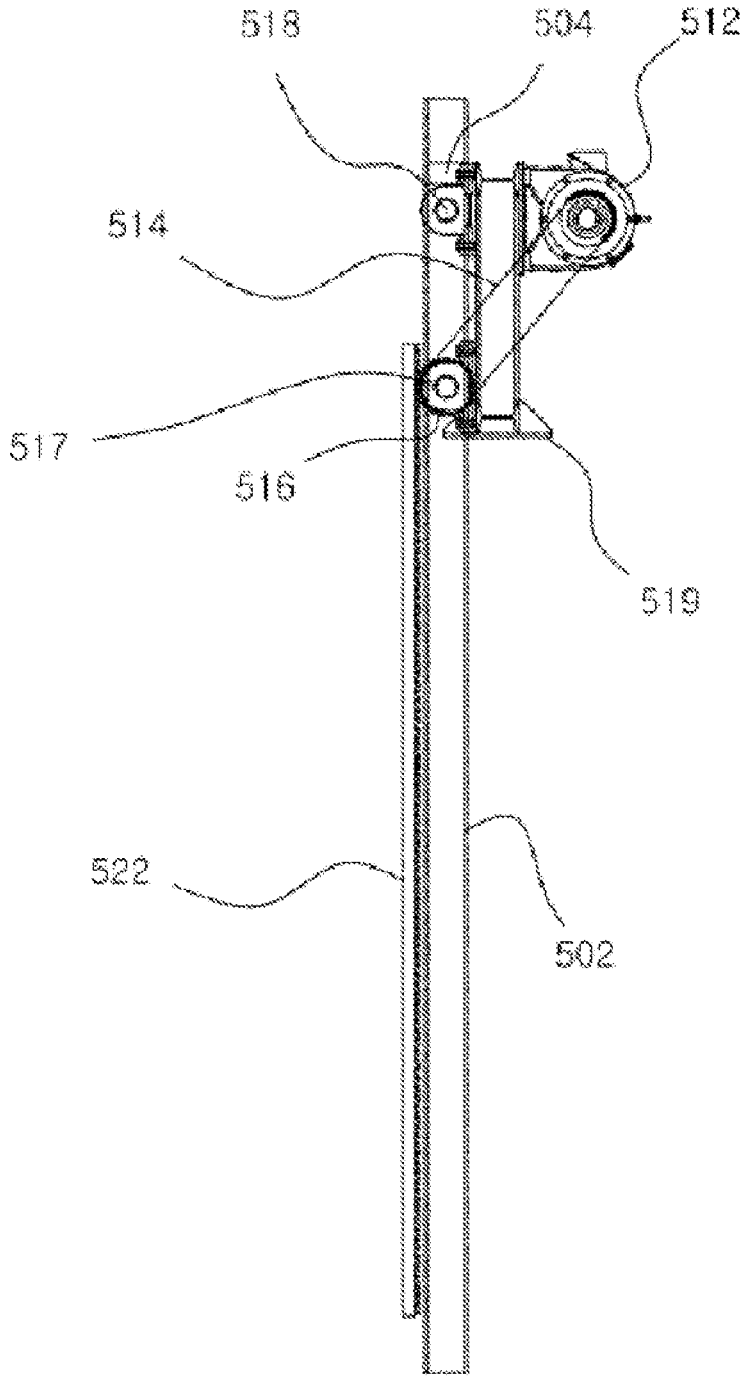
Figure 10:
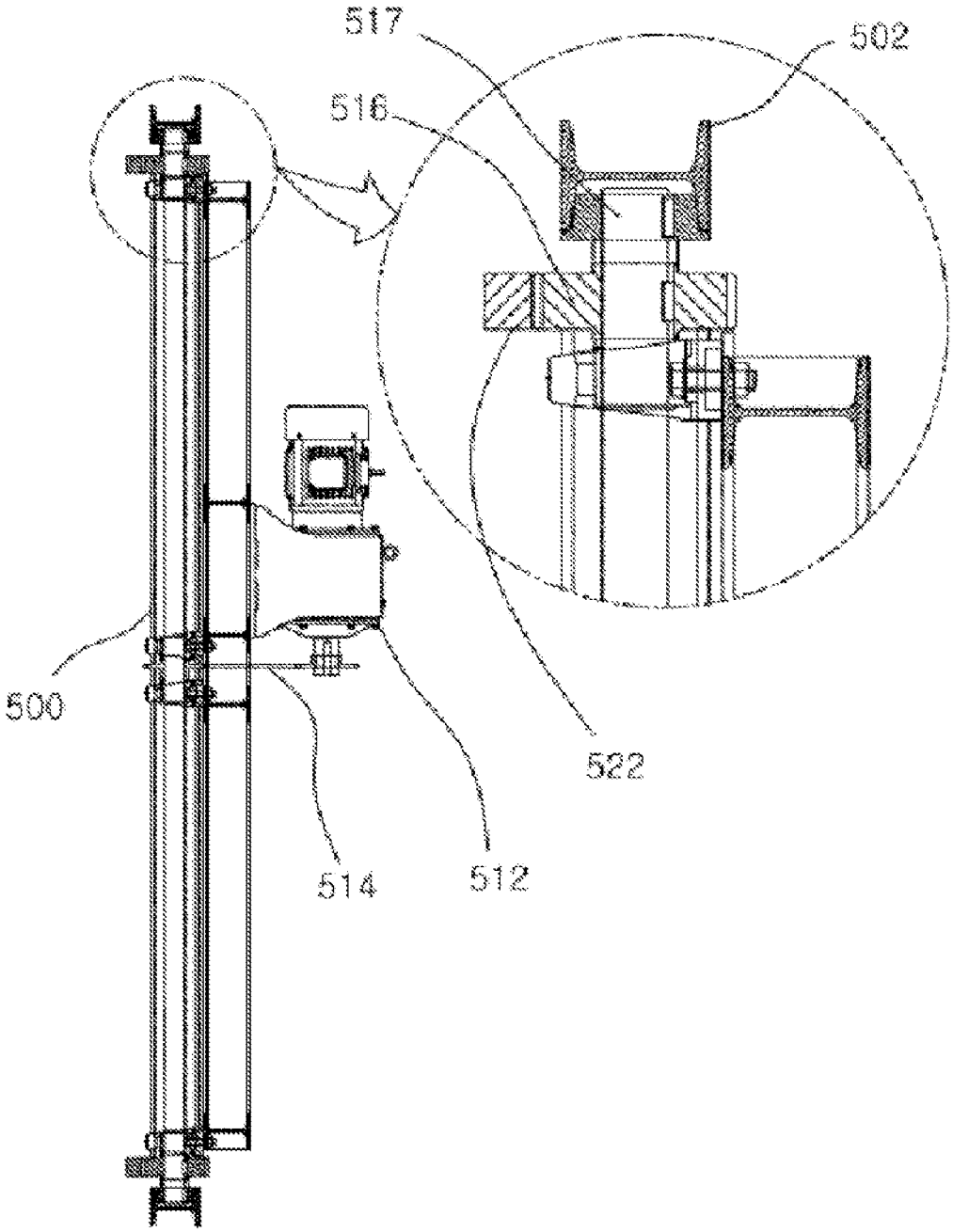

Referring to FIGS. 8 to 10, the ash processing module 50 may include an automatic ash processor 510 for pushing and removing the ash X remaining on the bottom door 20 while running in one direction, a guide frame 500 configured to support the automatic ash processor 510 and to guide the running of the automatic ash processor 510, and a rack gear frame 520 connected to and supported on the base frame 40 and having a rack gear 522 formed thereon.

The guide frame 500 may include a travel guide 502 configured to accommodate at least parts of driven wheels 517 and 518 of the automatic ash processor 510 to guide the movement of the driven wheels 517 and 518, and stoppers 504 configured to prevent the automatic ash processor 510 from being detached from the guide frame 500.

The travel guide 502 may be provided as a side portion of an I-beam extending in one direction so as to constitute a part of the guide frame 500. Specifically, the travel guide 502 may be defined as a space having a C-shaped cross section and constituting the side portion of the I-beam. The driven wheels 517 and 518 are accommodated in the C-shaped space to travel along the C-shaped space, whereby the travel of the automatic ash processor 510 can be guided by the travel guide 502.

In order to prevent the automatic ash processor 510 from being detached from the travel guide 502, the stoppers 504 may be provided at the position where the automatic ash processor 510 waits before processing the ash X and where the stoppers 504 make contact with the driven wheels 517 and 518 on the opposite side in the travel direction, and may be provided to partially close the C-shaped space of the travel guide 502. However, this is merely an example. The stoppers 504 may be provided in the rack gear frame 520 to prevent detachment of the automatic ash processor 510.

The automatic ash processor 510 may include a driving gear 516 configured to engage with a rack gear 522, a driving member 512 connected to the driving gear 516 to provide a rotational force to the driving gear 516, a driving belt 514 configured to connect the driving member 512 and the driving gear 516 to transmit the power of the driving member 512 to the driving gear 516, a first driven wheel 517 coaxially connected to the driving gear 516, a second driven wheel 518 having an axis different from the axis of the first driven wheel 517, and a push plate 519 provided at the front portion of the automatic ash processor 510 to push the ash X. Although the driving member 512 and the driving gear 516 are connected to each other through the driving belt in the present embodiment, a driving chain or the like may be used in place of the driving belt.

If the operation of the driving member 512 is started, the automatic ash processor 510 starts to make linear motion as the driving gear 516 is rotated and moved forward along the rack gear 522. At this time, a travel route can be set as the driven wheels 517 and 518 are guided by the travel guide 502. When the automatic ash processor 510 travels along the guide frame 500, the ash X accumulated on the upper side of the bottom door 20 is pushed by the push plate 519 and is removed from the bottom door 20. The ash X pushed by the push plate 519 may be stacked on a transport conveyor 530 installed on the ground paper and may be discharged.

The rack gear frame 520 extends along the travel direction of the automatic ash processor 510 and may be installed on the base frame 40. The rack gear 522 is formed on the upper surface of the rack gear frame 520. As the driving gear 516 engaged with the rack gear 522 is rotated, the automatic ash processor 510 may travel along the rack gear 522 to remove the ash X.

In the present embodiment, there has been described the case where the rack gear frame 520 is fixed to the base frame 40. However, this is nothing more than an example. The rack gear frame 520 may be installed in the main frame 30 or the guide frame 500 in place of the base frame 40.

Figure 11:
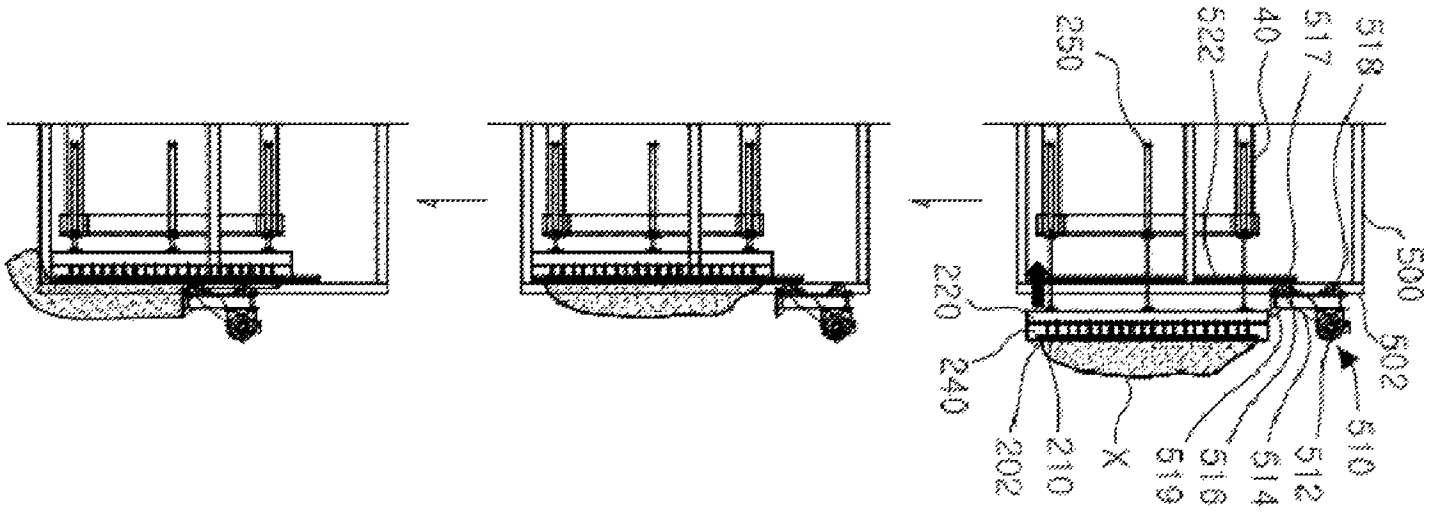
FIG. 11 is a view showing a process of removing ash on a bottom door using the automatic ash processor shown in FIG. 1.

Hereinafter, the operation and effect of the pyrolysis gasifier according to the embodiment of the present invention will be described with reference to FIG. 11. FIG. 11 is a view illustrating a process of removing the ash on the bottom door using the automatic ash processor shown in FIG. 1.

In order to start the combustion of wastes, the waste combustion chamber 100 in the tubular body 10 needs to be first filled with wastes. To this end, the wastes may be loaded into the waste feeding basket 330 through a means such as a separate crane or the like. When the wastes have been loaded into the waste feeding basket 330, the second hoist 320 is driven to open the lid 110, and then the first hoist 310 is driven to move the waste feeding basket 330 upward along the basket running rail 340 so as to approach the lid 110.

Since the basket running rail 340 is bent toward the lid 110 on the side of the lid 110, the waste feeding basket 330 rotates on the side of the lid 110 so that the wastes can be poured and loaded into the waste combustion chamber 100 of the tubular body 10. When the loading of the wastes into the waste combustion chamber 100 is completed, the lid 110 is closed again to seal the waste combustion chamber 100. Thereafter, the wastes can be burned.

As the combustion is completed, ash X remains on the upper side of the door body 200 of the bottom door 20. In order to remove the ash X, the lifting means 250 is driven to lower the door body 200. At this time, the lowering distance may be determined depending on the amount of the remaining ash X. To this end, the control unit for controlling the lifting means 250 may include a sensing means (not shown) for measuring the amount of the ash X. Furthermore, when the lifting means 250 is moved downward, the guide post 260 can also be lowered. At this time, a lubricant may be supplied to the surface side of the guide post 260 by the oil supply member 261.

When the door body 200 is lowered by an appropriate distance, the automatic ash processor 510 of the ash processing module 50 may start to travel. To this end, when the driving member 512 starts driving, the driving force of the driving member 512 is transmitted to the driving gear 516 through the driving belt 514 so that the driving gear 516 can start to rotate.

The driving gear 516 is rotated and moved forward along the rack gear 522 of the rack gear frame 520. Accordingly, the first driven wheel 517, which is coaxially connected to the driving gear 516, may start to rotate and may travel while being guided along the travel guide 502 of the guide frame 500.

As the automatic ash processor 510 travels, the push plate 519 may push the ash X outwardly of the door body 200 to drop the ash X as shown in FIG. 11. A transport conveyor 530 is disposed at a point where the ash X falls. Thus, the dropped ash X may be discharged by the transport conveyor 530.

In the process of pushing out the ash X with the automatic ash processor 510, the lifting means 250 may be applied with a considerable level of lateral load due to the load of the accumulated ash X and the crank phenomenon occurring in the combustion process. If such a load acts on the lifting means 250, the lifting means 250 may be damaged.

Therefore, the guide post 260 can be provided, and the lateral load can be dispersed by the guide post 260. This makes it possible to greatly reduce the lateral load applied to the lifting means 250.

In addition, due to the load of the accumulated ash X and the crank phenomenon occurring in the combustion process, a considerable level of resistance force also acts in the travel of the automatic ash processor 510. In order to cancel this resistance force, a driving force is applied to the driving gear 516 to rotate and travel along the rack gear 522. Therefore, a proper level of driving force can be secured as compared with the case where a driving force is merely applied to a wheel. Accordingly, the processing of the ash X can be performed smoothly despite the load of the ash X and the crank phenomenon occurring in the combustion process.

According to the pyrolysis gasifier comprising an automatic ash processor according to the present embodiment as described above, it is possible to automatically process ash without requiring an operator to manually process the ash. This makes it possible to continuously operate the pyrolysis gasifier. Thus, there is an effect that the time required for manually processing the ash is reduced and the process efficiency is enhanced. In addition, there is an effect that it is possible to eliminate the risk of burning an operator due to the remaining fire or the like in the ash processing process.

While the embodiments of the present invention have been described above with reference to the accompanying drawings, it will be understood by those skilled in the art that the invention may be implemented in other specific forms without changing the technical idea and the essential features. For example, those skilled in the art may change the material, size and the like of each constituent element depending on the application field, or may combine or substitute the embodiments in a form not clearly disclosed in the embodiments of the present invention. This does not depart from the scope of the present invention. Therefore, it should be understood that the above-described embodiments are illustrated and not restrictive in all respects. Such modified embodiments are included in the technical idea described in the claims of the present invention.

What is claimed is:

1. A pyrolysis gasifier, comprising:

a tubular body configured to receive and pyrolyze a combustible waste;

a bottom door disposed below the tubular body to selectively seal the tubular body;

a main frame supporting the tubular body;

a base frame supporting the bottom door;

an automatic ash processor configured to, while traveling in one direction, push and remove ash remaining on the bottom door after pyrolysis of the combustible waste;

a guide frame supporting the automatic ash processor and configured to guide the travel of the automatic ash processor; and a rack gear frame connected to and supported on anyone of the main frame, the base frame and the guide frame, and provided with a rack gear formed on an upper surface thereof, wherein the automatic ash processor includes a driving gear configured to engage with the rack gear, and a driving member connected to the driving gear to apply a rotational force to the driving gear, and wherein the bottom door includes a door body, a lifting means fixed to the base frame and connected at an end to the door body to raise and lower the door body, and a guide post vertically movably installed on the base frame and connected at an upper end to the door body.

2. The pyrolysis gasifier of claim 1, wherein the rack gear frame is formed to extend along a travel direction of the automatic ash processor, and the rotation of the driving gear cause the travel of the automatic ash processor.

3. The pyrolysis gasifier of claim 1, wherein the automatic ash processor further includes a driven wheel coaxially connected to the driving gear, and the guide frame includes a travel guide configured to accommodate at least a portion of the driven wheel to guide movement of the driven wheel.

4. The pyrolysis gasifier of claim 1, wherein the automatic ash processor further includes a first driven wheel coaxially connected to the driving gear and a second driven wheel having an axis different from an axis of the first driven wheel, and the guide frame includes a travel guide configured to accommodate at least portions of the first driven wheel and the second driven wheel to guide movement of the first driven wheel and the second driven wheel.

5. The pyrolysis gasifier of claim 1, wherein the automatic ash processor further includes a push plate provided at a front portion thereof and configured to push out ash so that when the automatic ash processor travels along the guide frame, the ash accumulated on the bottom door is pushed by the push plate and removed from the bottom door.

6. The pyrolysis gasifier of claim 1, further comprising:

a control unit configured to control an operation of the lifting means so that the height of the door body is adjusted depending on the amount of the ash accumulated on the door body.

7. The pyrolysis gasifier of claim 1, further comprising:

a main housing fixed to the base frame and configured to allow the guide post to vertically movably pass therethrough; and an oil supply member installed in the main housing, wherein an oil supply hole is formed to extend from a side surface of the main housing to a surface of a guide surface, and the oil supply member is installed in the oil supply hole so that a lubricant is supplied from the oil supply member to the surface of the guide post through the oil supply hole.

8. The pyrolysis gasifier of claim 7, further comprising:

a retainer housing fixed to an upper side of the main housing and configured to allow the guide post to vertically movably pass therethrough;

a post housing fixed to a lower side of the main housing and configured to allow the guide post to vertically movably pass therethrough; and oil retainers installed to prevent the lubricant supplied to the surface of the guide post from leaking out of the retainer housing and the post housing.

9. The pyrolysis gasifier of claim 8, wherein the oil retainers are installed above the retainer housing and below the post housing so as to make contact with the guide post.

10. The pyrolysis gasifier of claim 7, wherein the main housing has vertical grooves and horizontal grooves formed on a surface of a hole through which the guide post passes, the vertical grooves are recessed from the surface of the hole to extend in a vertical direction and formed along a circumference of the hole through which the guide post passes, and the horizontal grooves are recessed from the surface of the hole along the circumference of the hole through which the guide post passes.

11. The pyrolysis gasifier of claim 1, wherein the bottom door includes a door body, an air pocket provided inside the door body and configured to collect an air, an air supply duct connected to the air pocket and configured to provide a passage for supplying an air to the air pocket, and a blower fan connected to an end of the air supply duct and configured to supply an ambient air to the air pocket, at least a portion of the air supply duct composed of an extendible/retractable bellows tube.

12. A pyrolysis gasifier, comprising:

a tubular body configured to receive and pyrolyze a combustible waste;

a bottom door disposed below the tubular body to selectively seal the tubular body;

a main frame supporting the tubular body;

a base frame supporting the bottom door;

an automatic ash processor configured to, while traveling in one direction, push and remove ash remaining on the bottom door after pyrolysis of the combustible waste;

a guide frame supporting the automatic ash processor and configured to guide the travel of the automatic ash processor; and a rack gear frame connected to and supported on anyone of the main frame, the base frame and the guide frame, and provided with a rack gear formed on an upper surface thereof, wherein the automatic ash processor includes a driving gear configured to engage with the rack gear, and a driving member connected to the driving gear to apply a rotational force to the driving gear, and wherein the bottom door includes a door body, a lower cooling jacket provided within the door body and provided with an internal space through which a coolant can circulate, a coolant supply pipe connected to the lower cooling jacket and configured to provide a passage for supplying the coolant to the lower cooling jacket, a coolant discharge pipe connected to the lower cooling jacket and configured to provide a passage for discharging the coolant from the lower cooling jacket, and a cableveyor connected to the coolant supply pipe and the coolant discharge pipe and configured to be deformed in response to upward/downward movement of the door body.

13. The pyrolysis gasifier of claim 12, wherein the coolant discharge pipe and the coolant supply pipe are connected at the middle thereof to a high-pressure hose or a flexible hose.

* * * * *